US006168307B1

(12) United States Patent
Venås

(10) Patent No.: US 6,168,307 B1
(45) Date of Patent: Jan. 2, 2001

(54) ROTOR FOR THE TREATMENT OF LIQUID

(75) Inventor: Karl Venås, Saupstad (NO)

(73) Assignee: Norsk Hydro ASA, Olso (NO)

( * ) Notice: Under 35 U.S.C. 154(b), the term of this patent shall be extended for 0 days.

(21) Appl. No.: 09/348,753

(22) Filed: Jul. 7, 1999

(30) Foreign Application Priority Data

Jul. 8, 1998 (NO) ..... 19983142

(51) Int. Cl.[7] ..... B01F 13/02

(52) U.S. Cl. ..... 366/102; 366/169.1; 366/262; 261/87

(58) Field of Search ..... 366/101, 102, 366/169.1, 169.2, 170.2, 170.3, 170.4, 262, 263, 279; 261/85, 87, 86

(56) References Cited

U.S. PATENT DOCUMENTS

| | | | | |
|---|---|---|---|---|
| 988,149 | * | 3/1911 | Stussy | 366/169.1 |
| 2,166,772 | * | 7/1939 | Salsas-Serra | 366/102 |
| 2,341,536 | * | 2/1944 | Fash | 366/102 |
| 2,609,189 | * | 9/1952 | Dering | 261/87 |
| 2,743,914 | * | 5/1956 | Epprecht | 261/87 |
| 2,892,543 | * | 6/1959 | Daman | 261/87 |
| 3,067,988 | * | 12/1962 | Rodoz | 261/29 |
| 3,095,149 | * | 6/1963 | Peebles | 261/85 |
| 3,554,518 | | 1/1971 | Ostberg | 264/8 |
| 3,761,548 | | 9/1973 | Winter et al. | 266/235 |
| 4,249,828 | * | 2/1981 | Condolios | 366/102 |
| 4,297,214 | * | 10/1981 | Guarnaschelli | 261/87 |

FOREIGN PATENT DOCUMENTS

| | | | | |
|---|---|---|---|---|
| 23 43 001 | * | 3/1975 | (DE) | 366/170.2 |
| 1590125 | * | 9/1990 | (SU) | 366/169.1 |

* cited by examiner

*Primary Examiner*—Tony G. Soohoo
(74) *Attorney, Agent, or Firm*—Wenderoth, Lind & Ponack, L.L.P.

(57) ABSTRACT

A rotor for the treatment of a liquid such as molten metal by the addition of gas and/or particulate material. The rotor includes a hollow rotation body (1) with openings (5, 9, 10) in the base and side. The rotor is mounted on a shaft (2) and driven via the shaft by a drive unit and is designed to be lifted out of and lowered into the liquid. The hollow rotation body (1) is provided, in its cavity, with at least one partition wall (4) or at least one rotationally symmetrical hollow body so that one or more annuli (8) and a central cavity (7) are formed and that the gas and/or particulate material is/are supplied to the annuli (8) and the central cavity (7) via channels (3, 13) and/or holes (11) in the respective partition wall(s) or body(ies).

12 Claims, 6 Drawing Sheets

ROTOR FOR THE TREATMENT OF LIQUID

BACKGROUND OF THE INVENTION

1. Field of the Invention

The present invention concerns a rotor for the treatment of a liquid such as molten metal by the addition of gas and/or particulate material. The rotor comprises a hollow rotation body with openings in a base and side which is mounted on a shaft and driven via the shaft by a drive unit and which is designed to be lifted out of and lowered into the liquid.

2. Description of Related Art

Apparatus and methods have previously been known for treating a liquid and adding particulate material to it as stated above. The applicant's own Norwegian patent no. 155.447 describes a rotor for treating a liquid and adding material to it in which the rotor comprises a rotationally symmetrical hollow body and in which the material is added to the liquid via a hole drilled in the rotor shaft and emerges through holes in the side of the hollow body together with the liquid, which is sucked in, by means of centripetal force, through an opening in the base and circulated through the body.

This rotor produces a high liquid treatment capacity, i.e. the admixture of gas or particles, with very little agitation or turbulence in the liquid.

A general requirement for rotors for liquid treatment, in particular treatment of molten metals, is that the admixture of gas or particulate material is efficient. However, it is also desirable to avoid the creation of a great deal of agitation or turbulence which leads to an agitated surface and vortices in the liquid and which thus leads to increased admixture of gas from the surroundings (atmosphere).

SUMMARY OF THE INVENTION

The present invention represents a solution with respect to rotors for liquid treatment in which the efficiency of the admixture of the gas or particles to a liquid is almost doubled, but in which the agitation is unchanged compared to the solution disclosed in the applicant's own Norwegian patent. Moreover, the present invention represents a solution with respect to rotors in which the gas/particle requirement (consumption) is more than halved. The present invention is characterized in that the hollow rotation body is provided, in its cavity, with at least one partition wall or at least one rotationally symmetrical hollow body so that one or more annuli are formed and that gas and/or liquid is/are supplied to the annuli and the central cavity via channels and/or holes in the respective partition wall(s) or body(ies).

BRIEF DESCRIPTION OF THE DRAWINGS

The present invention will be described in the following in further detail using examples and with reference to the attached drawings, where FIGS. 1(*a*) and 1(*b*) show a known rotor, as described in applicant's own Norwegian patent no. 155.447, in particular, FIG. 1(*a*) is a cross-sectional view, and FIG. 1(*b*) is a top plan view.

FIG. 2(*b*) is a top plan view of the rotor show in FIG. 2(*a*).

FIG. 2(*c*) is a side view of the rotor shown in FIG. 2(*a*).

DETAILED DESCRIPTION OF THE INVENTION

Figure 1A:
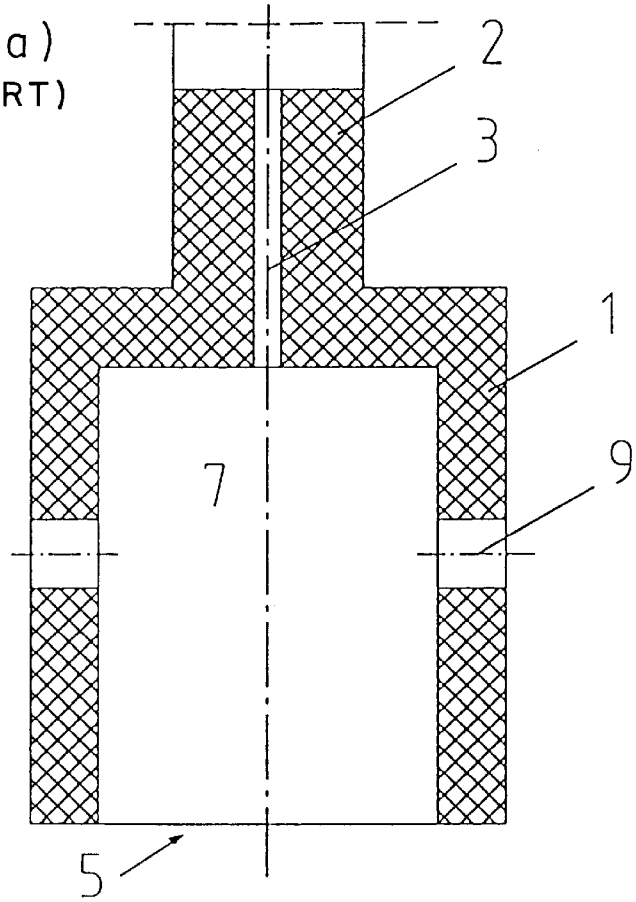
FIG. 1(a) (PRIOR ART)
Figure 1B:
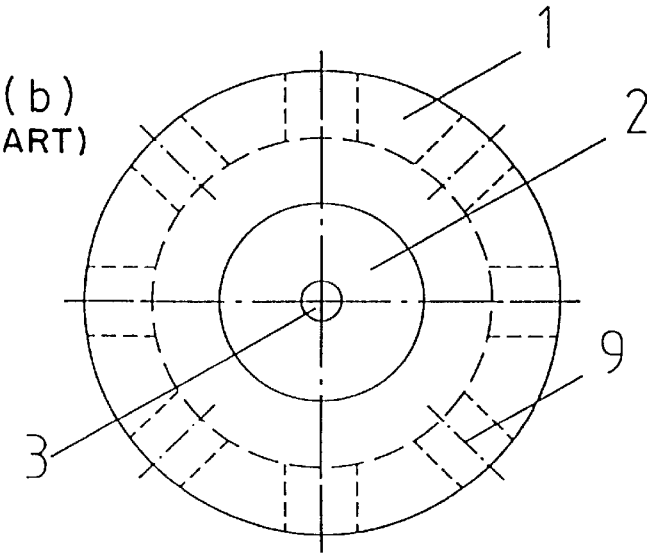
FIG. 1(b) (PRIOR ART)

As stated above, FIG. 1 shows a known rotor as disclosed in the applicant's own Norwegian patent no. 155.447. The rotor consists of a hollow, rotationally symmetrical body which has a smooth surface both externally and internally and which is provided with openings 5, 9 in the base and sides. The body 1 is connected to a shaft 2 which, in turn, is driven by a drive unit (not shown). Gas and/or particulate material is/are supplied to the rotor through a drilled hole 3 and, when the rotor is in operation, i.e. when the rotor is rotating, the gas, and the liquid which is sucked into the rotor through the hole 5 in the base, will be pressed out through the openings 9 in the side and will be finely distributed in the liquid.

Figure 2A:
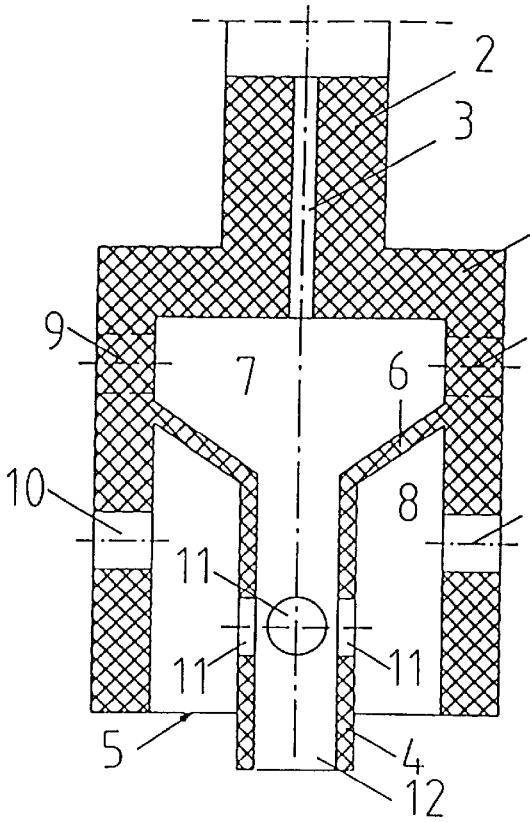
FIG. 2(*a*) is a cross-sectional view of a rotor in accordance with the present invention.
Figure 2C:
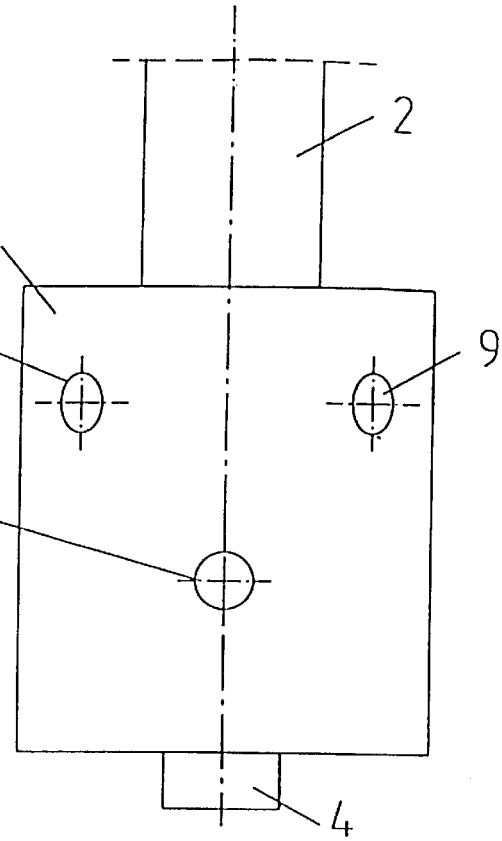
Figure 2B:
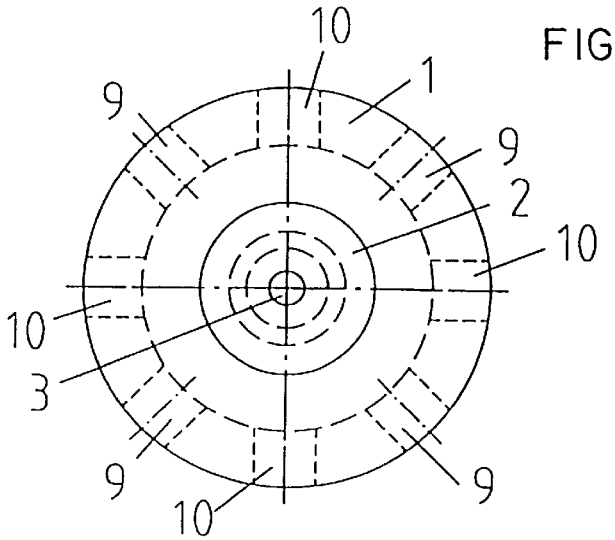

FIGS. 2(*a*)–2(*c*) show a first example of a rotor constructed in accordance with the present invention. The rotor comprises a rotationally symmetrical body 1, preferably cylindrical, which has a smooth surface externally and internally and which is connected to a shaft 2 with a coaxial drilled hole 3 for the supply of gas and/or particulate material. The shaft 2 is connected to and driven by a drive unit (not shown).

The special aspect of the present invention is that the rotation body 1 is provided with an internal, rotationally symmetrical partition wall 4 which extends just below the opening 5 in the body 1 and which, at its upper end, extends outwardly in a funnel-shaped part 6 and is fastened to the body 1 internally. The partition wall 4 thus defines an internal, central cavity 7 and an annulus 8 or annular chamber. In the example shown here, the body 1 is provided with four upper holes 9, which correspond to the centric cavity 7, and four lower holes 10 which correspond to the annulus 8. Moreover, the partition wall 4 is provided with four holes 11, which form a link, i.e. establish communication between the centric cavity 7 and the annulus 8. The holes 9, 10, 11 can be arranged along the same vertical line or can be offset along the circumference of the rotor.

The rotor in accordance with the present invention functions as follows: the rotor is lowered into a liquid, for example molten metal, and is caused to rotate. The liquid will now, on account of the rotation of the rotor and the consequent centripetal force produced in the liquid, be sucked up, partially through the annular opening 5 formed between the partition wall 4 and the wall of the body 1, and partially through the opening 12 for the centric cavity 7 formed by the partition wall 4. The liquid will be pumped out through the holes 11 and 10. Gas and/or particles which is/are supplied through the drilled hole 3 in the rotor shaft will, at the same time, partially be pressed through the upper holes 9 and partially through the lower holes 11 in the rotor wall and the partition wall 4. The gas which flows through the holes 9 will immediately be broken down into small gas particle fractions on the outside of the hole on account of the friction against the liquid on the outside of the rotor. The gas, together with the liquid which flows out through the holes 11, will be partially broken down and flow up towards the lower holes 10 in the rotor wall 1 and will be further broken down into small gas particle fractions immediately on the outside of the holes 10 in the same way as the gas which flows through the holes 9.

Figure 3A:
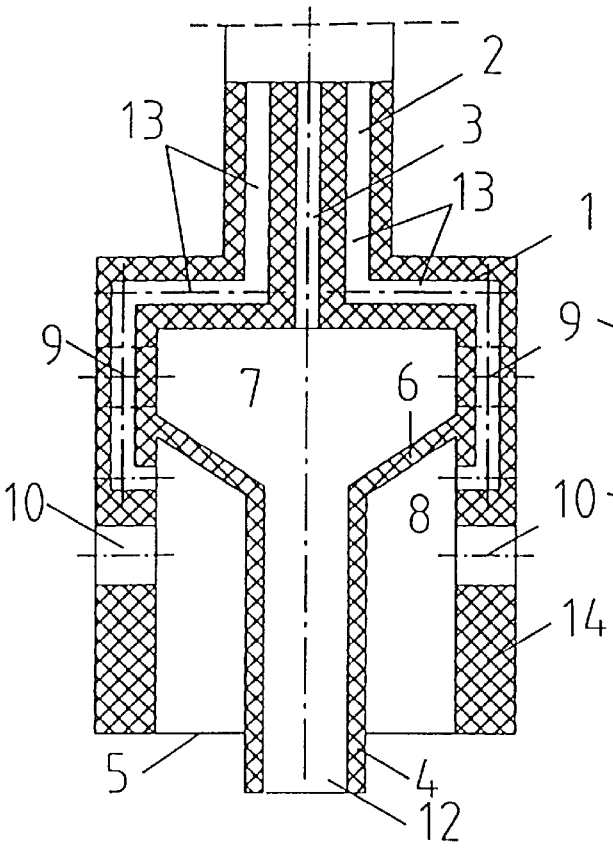
FIGS. 3(*a*)–3(*c*) show an alternative embodiment of the rotor shown in FIGS. 2(*a*)–2(*c*) in accordance with the present invention, wherein FIG. 3(*a*) is a cross-sectional view, FIG. 3(*b*) is a top plan view, and FIG. 3(*c*) is a side view.
Figure 3C:
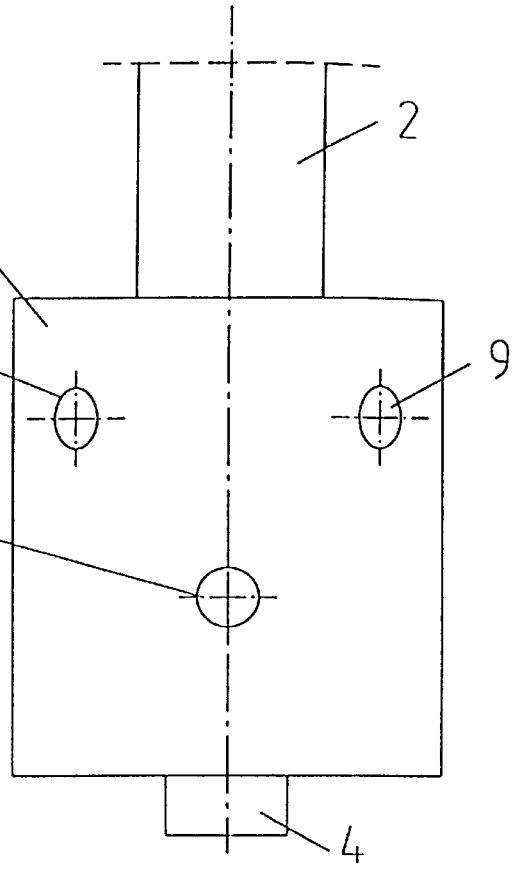
Figure 3B:
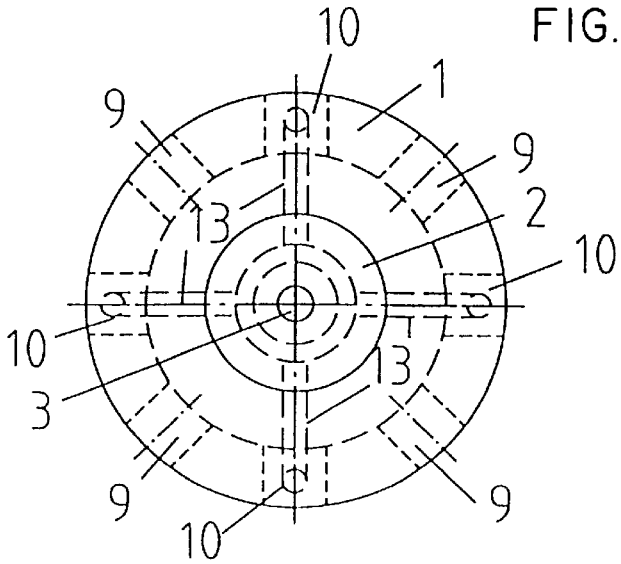

FIGS. 3(*a*)–3(*c*) show an alternative embodiment of the solution shown in FIG. 2. The rotation body 1, the partition wall 4 and the upper and lower holes 9 and 10 are the same. The difference is that the holes 11 in the partition wall 4 have been removed. Instead, gas is supplied to the annulus 8 via drilled holes 13 in the wall 14 in the rotor 1 and shaft 2. Gas is supplied to the centric chamber 7 through the central drilled hole 3 in the shaft 2 in the same way as in the example shown in FIG. 2.

In this example, the liquid will be sucked up into the centric chamber and flow out through the upper holes 9 together with the gas supplied through the drilled hole 3, and the liquid which is sucked up into the annulus 8 will flow out through the lower holes 10 together with the gas supplied through the drilled holes 13 in the shaft 2 and the rotor wall 14. The principle and method of operation are otherwise the same as in the example above. This solution shown in FIG. 3 is somewhat more expensive to produce than the solution shown in FIG. 2 as a result of the drilled holes 13 in the rotor wall/shaft. However, the efficiency in connection with the admixture of gas is somewhat higher.

Figure 4:
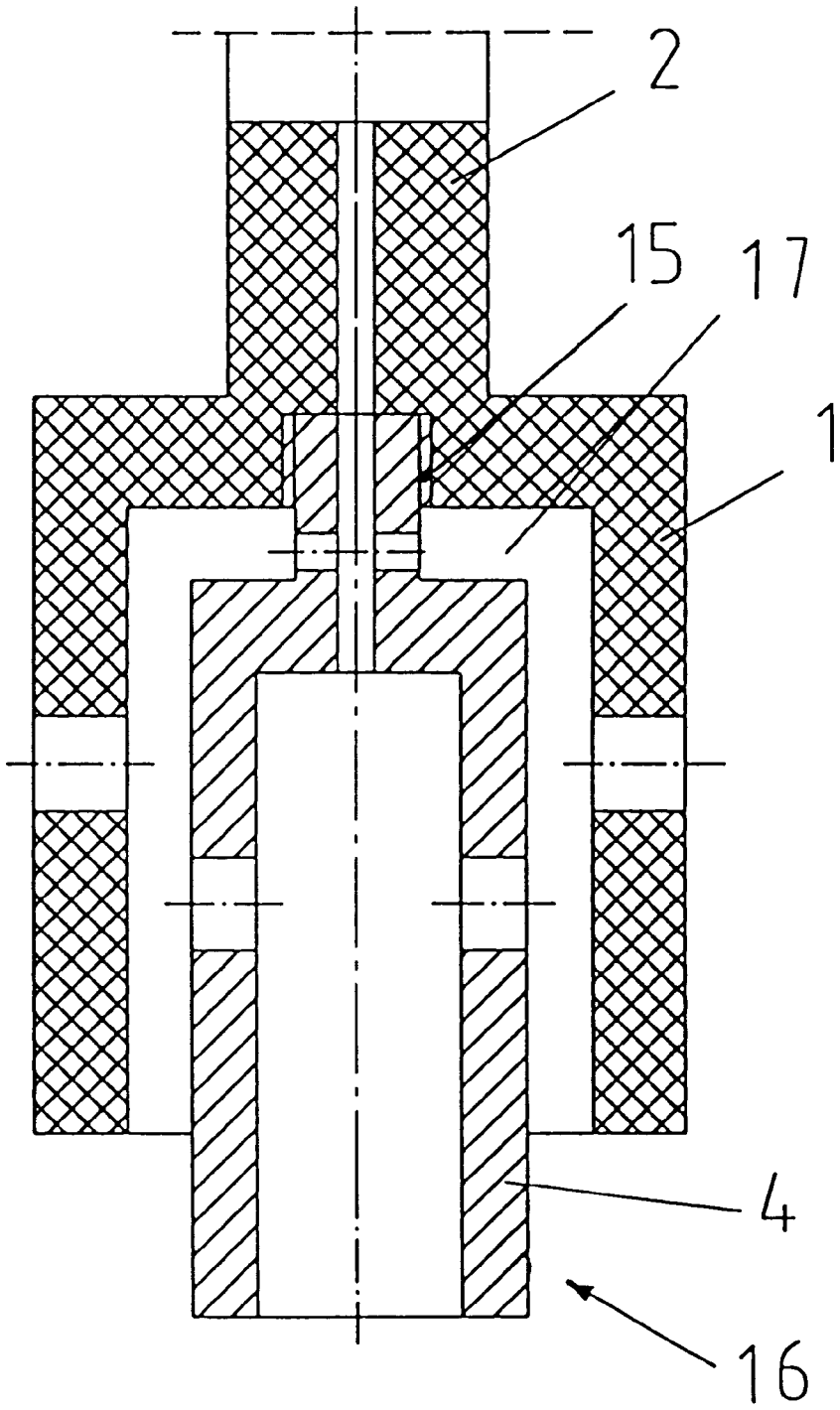
FIG. 4 shows another alternative embodiment of the present invention in which, instead of partition walls, an internal rotor is used.

The present invention, as it is defined in the claims, is not limited to the examples shown in the drawings and described above. For example, instead of partition walls which are permanently connected to the rotation body 1, a second rotationally symmetrical body 16 can be arranged inside the cavity in the rotation body 1 by means of a coupling piece 15 or another method, as shown in FIG. 4. The wall of the second rotation body 16 thus forms a partition wall 4. It is expedient for the second rotor not to be screwed completely in so that an opening 17 between the rotors is formed. This allows the gas for the outer chamber 8 to be supplied via the shaft drilled hole 3 and through the gap 17 between the two rotors.

Figure 5:
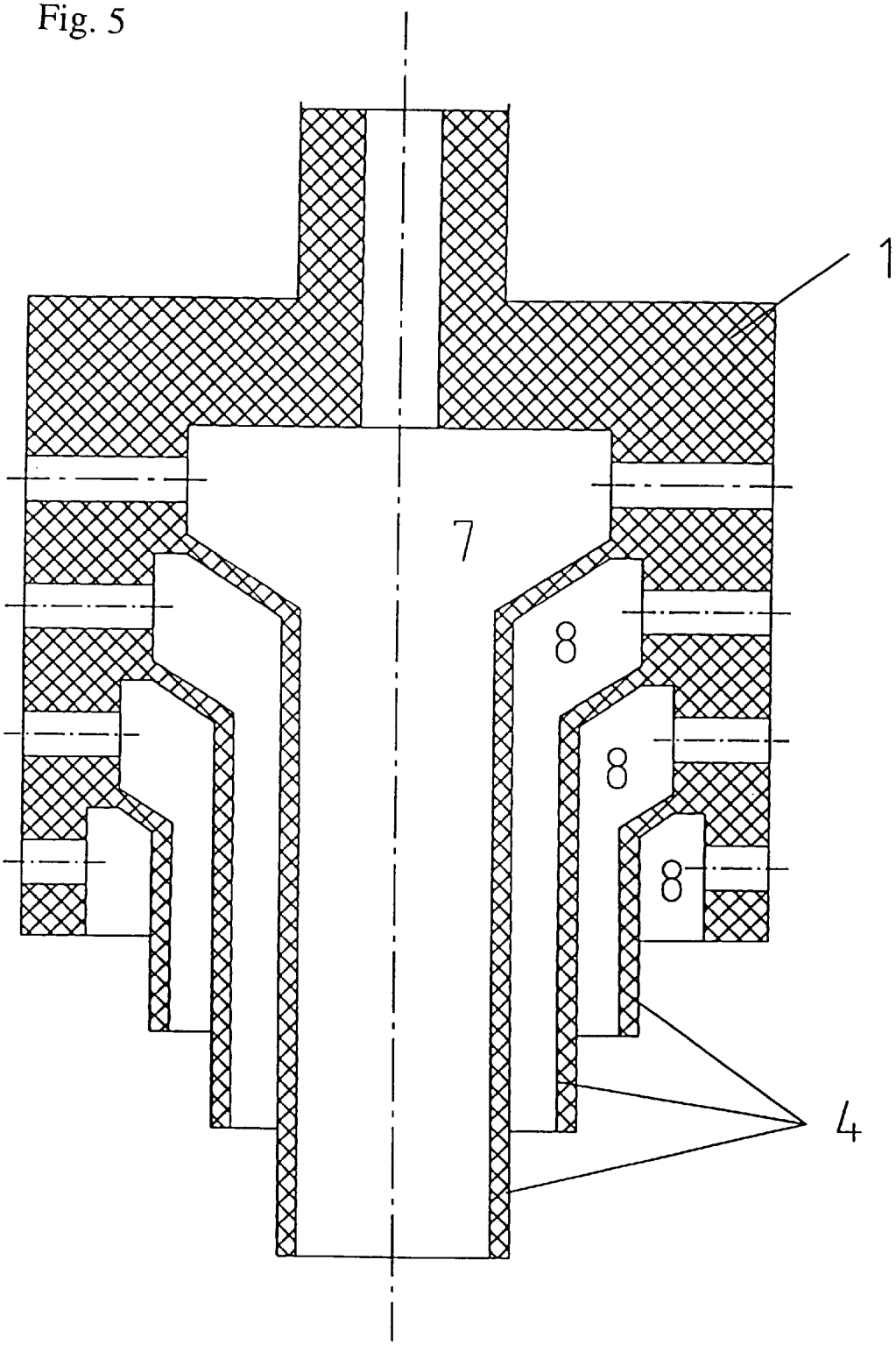
FIG. 5 shows another embodiment of a rotor constructed in accordance with the present invention with several partition walls seen in cross-section.

Moreover, the present invention is not limited to one partition wall. It may have two or more partition walls or internal rotors. FIG. 5 shows an example of a rotor 1 in which three partition walls 4 are used to divide the internal cavity in the rotor into a central chamber 7 and three annuli 8 to which gas can expediently be supplied in the same way as shown in FIG. 2 or 3 (not shown in further detail).

With several partition walls, the efficiency can be further improved in comparison with the solutions shown in FIGS. 2 and 3 and the consumption of gas/particles will be further reduced.

Tests:

Comparative tests were performed with a known rotor as shown in FIG. 1 and a new rotor in accordance with the present invention as shown in FIG. 3. The tests were based on the removal of oxygen from water using nitrogen gas.

The rotors were tested in a container in a water model with water flow of 63 I/min. The rotors which were tested were in the scale 1:2 in relation to standard size. The external dimensions were the same and the holes in the base and side had the same diameter.

The rotors were driven by a motor of 0.55 kW at 910 RPM at 50 Hz. The RPM were regulated using a 3 kW regulator of type Siemens Micromaster with a variation range of 0–650 Hz.

Nitrogen gas from a 200-bar, 50-liter nitrogen bottle was used and the gas was supplied through the drilled hole in the rotor shaft via a reduction valve and rotameters of type Ficher and Porter. The oxygen in the water was measured with an oxygen meter of type YSI model 58 (digital meter).

Furthermore, a water meter of type 5px (Spanner-Pollux GmbH) with a capacity of 2.5 m3/h was used to measure the water quantity.

Moreover, a digital tochmeter of type SHIMPO DT-205 was used to determine the RPM.

The two rotors were tested in the same container under the same conditions with a water flow of 63 I/min. After adjusting the water quantity, each rotor was started and the RPM were regulated to the desired speed. The oxygen measurement and timekeeping were started as the supply of nitrogen gas was switched on. Three different RPM values were used during the tests, 630, 945 and 1071 RPM, which, for rotors in the scale 1:1, would be equivalent to 500, 750 and 85 RPM respectively. Moreover, five different gas quantities were used during the tests: 12, 6; 25, 2; 37, 8; 50, 4 and 63 IN/min.

For the rotor in accordance with the present invention as shown in FIG. 3, the gas was introduced in four different ways:

Gas only in the upper row of holes

Gas only in the lower row of holes

Equal gas quantities in both rows of holes, a total of: 12, 6; 25, 2; 37, 8; 50, 4; 63 IN/min.

Double gas quantities, i.e. in each row of holes: 12, 6; 25, 2; 37, 8; 50, 4 and 63 IN/min.

Figure 6:
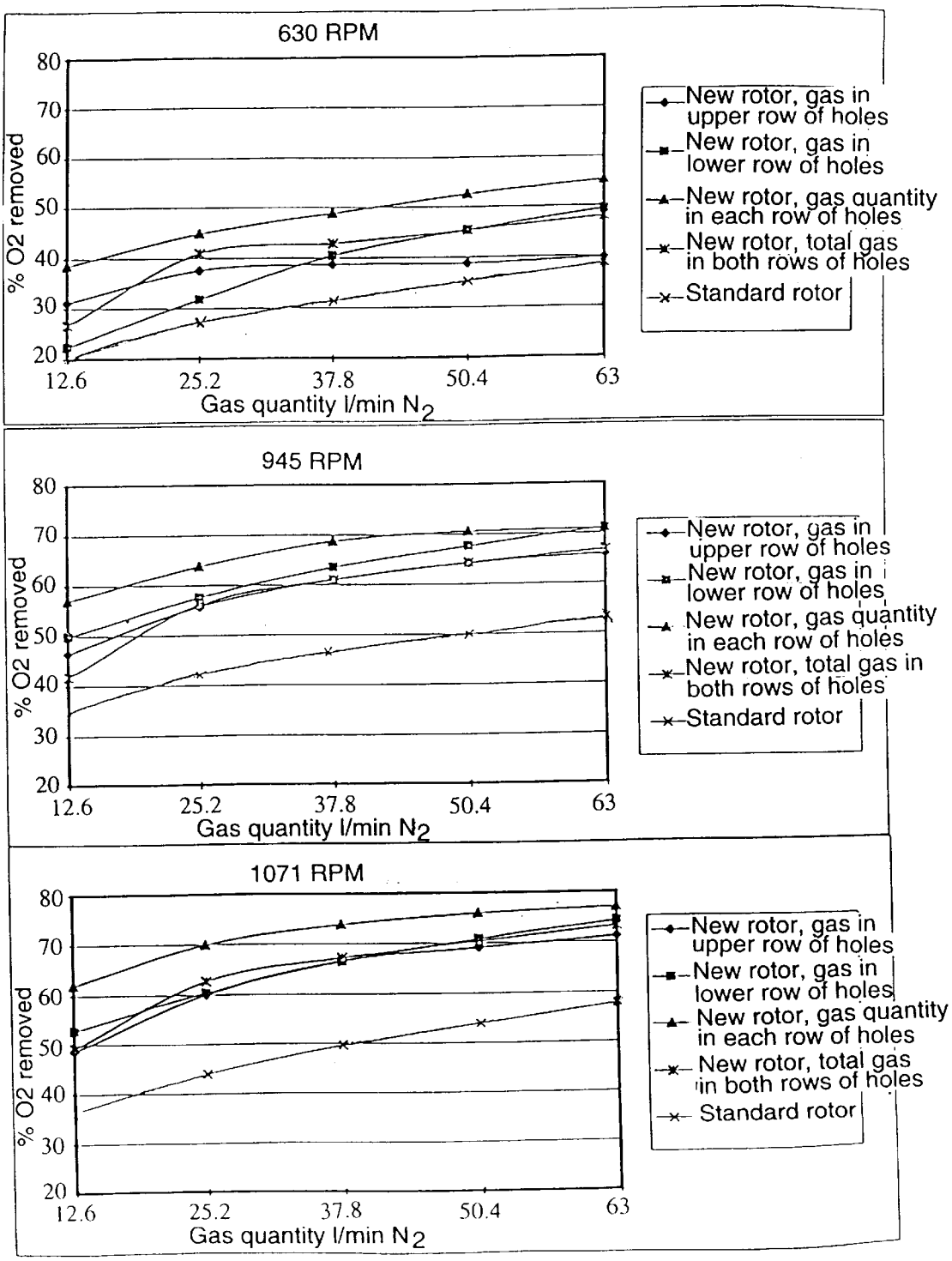
FIG. 6 shows diagrams of results from comparative tests at three different RPM values.

The results of the tests are shown in FIG. 6, which shows three diagrams, one for each RPM value. The known rotor as shown in FIG. 1, which, in the diagrams, is designated the "standard rotor", was, until the present invention was conceived, considered to be the best on the market in terms of efficiency together with low turbulence and agitation.

In the tests, it was possible to see that the agitation and turbulence in the liquid (water) were just as low with the new rotor in accordance with the present invention. The diagrams show, however, that the efficiency of the new rotor, measured as oxygen removed from the water, is nearly twice that of the known rotor at low quantities of nitrogen gas supplied and is improved by approximately 50% at the highest quantity of nitrogen gas supplied. The diagrams also show that it does not matter greatly where the nitrogen gas is supplied in the rotor, i.e. whether it is supplied to the upper or lower row of holes or to both rows of holes simultaneously. This is on account of the good bubble distribution achieved with the new rotor and the fact that part of the gas is pressed back into the rotor before being distributed out through both rows of holes.

What is claimed is:

1. A rotor for treating liquid, said rotor comprising:

a hollow rotation body defining an interior space and having an open lower end;

a rotatable shaft connected to an upper end of said hollow rotation body, said shaft having a longitudinal flow passage communicating with the interior space of said hollow rotation body;

at least one partition member disposed in the interior space of said hollow rotation body, said partition member extending from an interior peripheral surface of said hollow rotation body so as to define a central chamber and at least one annular chamber between the interior peripheral surface of said hollow rotation body and an outer peripheral surface of said partition member;

at least one hole formed in a side wall of said hollow rotation body and communicating with the annular chamber; and at least one hole formed in said partition member and establishing communication between the annular chamber and the central chamber, wherein additive material can be supplied to the annular chamber and the central chamber via the longitudinal flow passage formed in said rotatable shaft and the hole formed in said partition member.

2. A rotor as claimed in claim 1, wherein the longitudinal flow passage is coaxial with respect to said rotatable shaft.

3. A rotor as claimed in claim 1, further comprising at least one upper hole formed in the side wall of said hollow rotation body, the upper hole communicating directly with the central chamber.

4. A rotor as claimed in claim 1, wherein said partition wall comprises an upper funnel shaped wall and a lower cylindrical member, wherein said upper funnel shaped wall and said lower cylindrical member are concentric with respect to said hollow rotation body.

5. A rotor as claimed in claim 1, wherein said partition member extends below the open lower end of said hollow rotation body.

6. A rotor as claimed in claim 1, wherein said partition member comprises a vertical cylindrical partition.

7. A rotor as claimed in claim 1, wherein said partition member, in horizontal cross section, has a circular shape.

8. A rotor for treating liquid, said rotor comprising:

a hollow rotation body defining an interior space and having an open lower end;

a rotatable shaft connected to an upper end of said hollow rotation body, said shaft having a concentric longitudinal flow passage communicating with the interior space of said hollow rotation body, and at least one flow passage that is radially spaced from the concentric longitudinal flow passage and communicating with the interior space of said hollow rotation body;

at least one vertical partition member disposed in the interior space of said hollow rotation body, said partition member extending from an interior peripheral surface of said hollow rotation body so as to define a central chamber and at least one annular chamber between the interior peripheral surface of said hollow rotation body and an outer peripheral surface of said partition member; and at least one hole formed in a side wall of said hollow rotation body and communicating with said annular chamber;

wherein gas and particulate material can be supplied to the annular chamber and the central chamber via the concentric longitudinal flow passage and the radially spaced flow passage, respectively.

9. A rotor as claimed in claim 8, wherein said partition wall extends below the open lower end of said hollow rotation body.

10. A rotor for treating liquid, said rotor comprising:

a hollow rotation body defining an interior space and having an open lower end;

a rotatable shaft connected to an upper end of said hollow rotation body, said shaft having a longitudinal flow passage communicating with the interior space of said hollow rotation body;

a plurality of concentric partition members disposed in the interior space of said hollow rotation body so as to define a central chamber and a plurality of annular chambers, wherein each of said partition members includes a cylindrical portion;

at least one upper through hole formed in a side wall of said hollow rotation body and communicating with said central chamber; and a plurality of holes formed in the side wall of said hollow rotation body and communicating with said annular chambers, respectively.

11. A rotor as claimed in claim 10, wherein each of said partition walls comprises an upper funnel shaped wall and a lower cylindrical member, wherein said upper funnel shaped wall and said lower cylindrical member are concentric with respect to said hollow rotation body.

12. A rotor as claimed in claim 10, wherein said partition wall extends below the open lower end of said hollow rotation body.

* * * * *